United States Patent [19]

Pollard

[11] 4,174,798

[45] Nov. 20, 1979

[54] PORTABLE POCKET FOR POCKET WATCHES

[76] Inventor: Ray E. T. Pollard, 5941 La Jolla Mesa Dr., La Jolla, Calif. 92037

[21] Appl. No.: 845,888

[22] Filed: Oct. 27, 1977

[51] Int. Cl.[2] ..... A45C 11/10

[52] U.S. Cl. ..... 224/253; 24/3 F; 224/903

[58] Field of Search ..... 224/4 C, 5 R, 26 R, 224/26 D, 26 F, 26 K, 4 A, 28 B, 28 W, 164, 170, 191, 195, 224, 253, 903; 2/247; 24/3 R, 3 F; 229/40

[56] References Cited

U.S. PATENT DOCUMENTS

| | | | |
|---|---|---|---|
| D. 23,683 | 10/1894 | Porro | 224/26 D X |
| 744,933 | 11/1903 | Nicholson | 224/4 C |
| 862,321 | 8/1907 | Ehrentreu | 2/247 |
| 964,620 | 7/1910 | Dana | 224/26 D X |
| 3,269,531 | 8/1966 | Weiss | 229/40 X |
| 4,047,650 | 9/1977 | Domingos | 224/26 R X |

FOREIGN PATENT DOCUMENTS

| | | | |
|---|---|---|---|
| 6866 | of 1915 | United Kingdom | 224/28 B |

*Primary Examiner*—Stephen G. Kunin
*Assistant Examiner*—Winston H. Douglas
*Attorney, Agent, or Firm*—Natalie Jensen

[57] ABSTRACT

A watch pocket for mounting on a belt includes a pair of pliable sheets shaped and secured together to form an upwardly opening pocket and a transverse belt receiving loop behind the pocket with a pair of vertical relief slits formed in the wall between the pocket and loop to provide relief of pressure on the center of the watch and permit the pocket to assume the curvature of the body around which the belt is fastened.

3 Claims, 6 Drawing Figures

PORTABLE POCKET FOR POCKET WATCHES

BACKGROUND OF THE INVENTION

The present invention relates to clothing accessories and pertains particularly to a portable watch pocket.

It is presently the practice of manufacturers of men's clothing to construct such articles without any special provision for a pocketwatch. Prior to the market ascendancy of the wristwatch, most personal timepieces were what is known in the art as pocketwatches. As a convenience to consumers who routinely carried such timepieces on their person, clothing manufacturers routinely included a small watch pocket in the design of their garments. Such a pocket was included in the vest of the garment if a vest were indeed provided, in the waste-band of the trousers of such a suit, or as a small pocket constructed within the large side pocket common to almost all men's trousers. A separate pocket for the watch isolated it from other personal effects frequently carried in pockets, some of which, like keys or coins, would damage the surface finish of a fine watch. A specific watch pocket also served to locate the timepiece eliminating the problem of searching all the pockets to find the watch.

With the market ascendancy of the wristwatch, the demamd for garments with a specific watch pocket substantially diminished. Vests, long in fashion, were also eliminated from most suits as a matter of cost and of style. People who wished to carry a pocketwatch were forced to carry it in a general pocket where it was subject to damage from other articles in the pocket or from impacting external objects.

It is therefore desirable that a watch pocket be made available that can be worn on a belt, and therefore transferable to any garment accommodating a belt; said watch pocket providing protection to a pocketwatch contained therein.

SUMMARY AND OBJECTS OF THE INVENTION

It is, therefore, the primary object of the present invention to overcome the above problems of the prior art.

Another object of the present invention is to provide a portable watch pocket that can be worn on a belt and provide protection to a watch from damage by external objects.

In accordance with the present invention, a watch pocket is constructed of first and second sheets of heavy pliable material secured together to define an upwardly opening pocket having a belt loop behind the pocket with stress relieving means between the pocket and loop and gripping means along the sides.

BRIEF DESCRIPTION OF THE DRAWINGS

The above and other objects and advantages of the present invention will become apparent from the following description when read in conjunction with the accompanying drawing wherein.

DETAILED DESCRIPTION OF A PREFERRED EMBODIMENT

Figure 6:
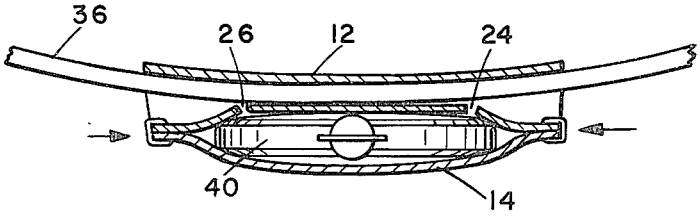
FIG. 6 is a view similar to FIG. 5, but showing the pocket on a belt with a watch in place.

Turning to the drawings, a pouch designated generally by the numeral 10 is constructed of first and second panels 12 and 14 of a durable, pliable material such as heavy leather or plastic material. The panel 12 is elongated and about twice the length of panel 14 with parallel sides 16 and 18 and rounded ends 20 and 22. The panel 12 also has a pair of parallel slits 24 and 26 extending generally along parallel to the sides and the longitudinal axis of the panel. These slits 24 and 26 serve to relieve stress in the pocket and provide a low pressure recess into which one side, preferably the crystal (i.e., face) of a watch 40 rests, as seen in FIG. 6. The portions of the panel to the outside of the recess grip the periphery of the watch.

The panel 14 includes parallel sides 28 and 30, with a rounded end 32 and a straight end 34. In assembling the pouch, the long panel 12 is folded over and the ends secured together to form the belt loop and the panels 12 and 14 secured together by any suitable fastening means such as gluing, riveting or stitching 38 as shown. The ends of panel 12 are secured togther and the end and both sides of panel 14 and one half of the panel 12 secured together for forming the pouch.

Figure 1:
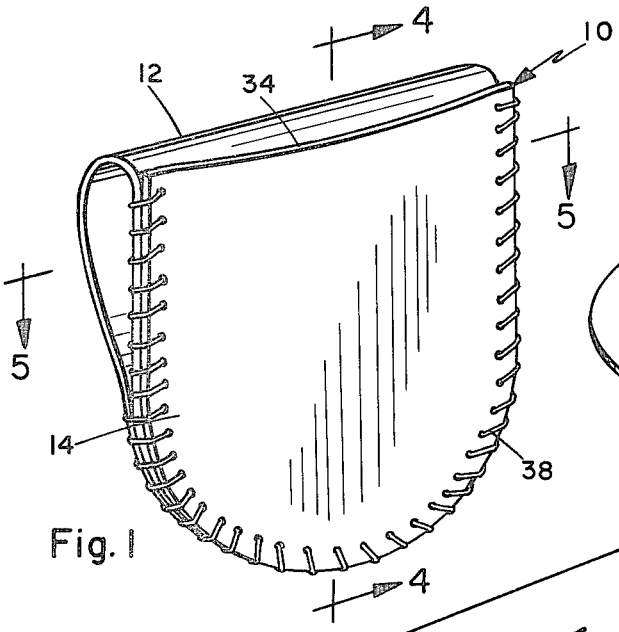
FIG. 1 is a perspective view of the pocket.
Figure 2:
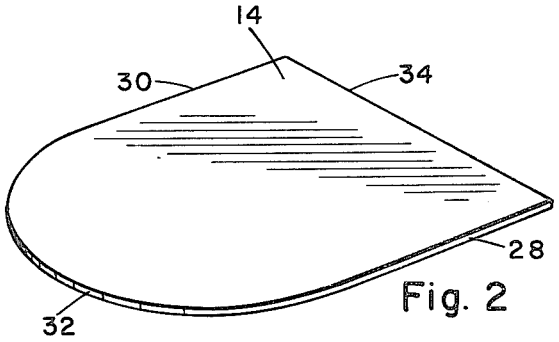
FIG. 2 is a perspective view of the front panel blank.
Figure 3:
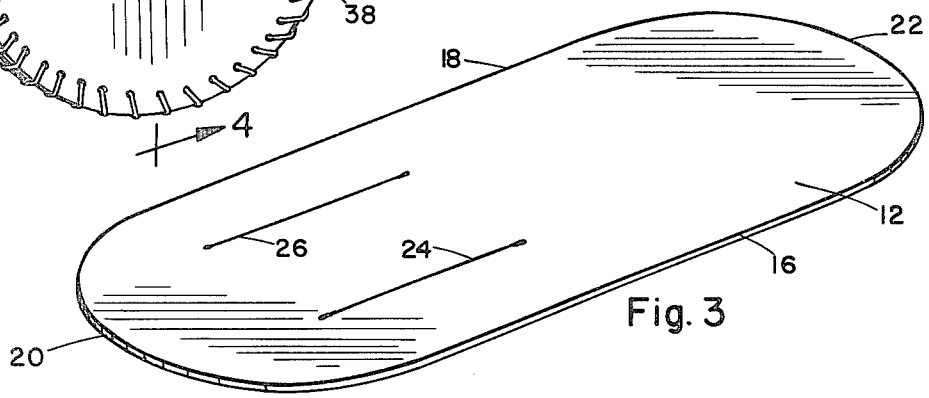
FIG. 3 is a perspective view of the rear panel blank.
Figure 4:
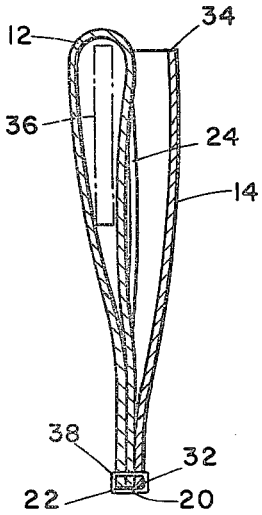
FIG. 4 is a sectional view taken on line 4—4 of FIG. 1.
Figure 5:
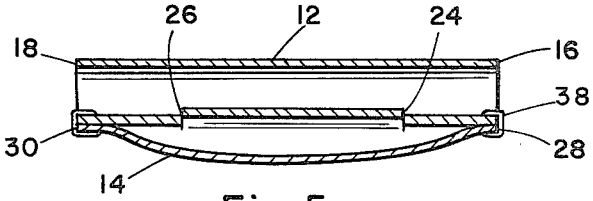
FIG. 5 is a sectional view taken on line 5—5 of FIG. 1.

The loop receives a belt 36 as shown in FIGS. 4 and 6 and when the belt is tightened about the body of an individual a bowing effect is created which causes the sides of the pouch to move toward the watch, as shown by the arrows, thereby gripping the edge of periphery of the watch. This construction provides a compact and secure pouch for a watch.

While I have described my invention by means of a single embodiment, it is to be understood that numerous changes and modifications may be made therein without departing from the spirit and scope of the invention as defined in the appended claims.

What is claimed is:

1. A portable watch pocket, said pocket comprising: a first elongated sheet of rugged, pliable material having generally parallel sides and rounded ends folded over with the ends secured together for defining a belt receiving loop, and a second sheet of rugged, pliable material having the general size and configuration of one half of the first elongated sheet with a rounded end, a generally straight end and two sides edges, said second sheet secured along its two sides and rounded end to said first sheet thereby defining an upwardly opening pocket, wherein one wall of said pocket is defined by said first sheet and the other wall is defined by said second sheet, and a pair of spaced apart independent vertical slits formed in said one wall of said pocket for creating a bowing effect when the watch pocket is strapped to a body so that the sides of the upwardly opening pocket move inwardly toward one another for gripping the edge of a watch therein.

2. The portable watch pocket of claim 1 wherein said material is leather.

3. The portable watch pocket of claim 2 wherein said first and second sheets are secured together by stitching.

* * * * *